US006739883B1

(12) United States Patent
Cheng et al.

(10) Patent No.: US 6,739,883 B1
(45) Date of Patent: May 25, 2004

(54) CABLE END CONNECTOR ASSEMBLY

(75) Inventors: Chung-Ta Cheng, Santa Clara, CA (US); Jie Cheng, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/622,953

(22) Filed: Jul. 18, 2003

(51) Int. Cl.[7] ..... H01R 4/66
(52) U.S. Cl. ..... 439/98; 439/497; 439/610
(58) Field of Search ..... 439/98, 610, 497, 439/101, 579, 623, 502

(56) References Cited

U.S. PATENT DOCUMENTS 4,111,513 A * 9/1978 Thurston et al. ..... 439/610
5,829,991 A * 11/1998 Murphy et al. ..... 439/98
6,129,581 A * 10/2000 Lee ..... 439/497
6,231,384 B1 * 5/2001 Kuo ..... 439/545
6,250,936 B1 * 6/2001 Armistead et al. ..... 439/98

* cited by examiner

*Primary Examiner*—Tho D. Ta
(74) *Attorney, Agent, or Firm*—We Te Chung

(57) ABSTRACT

A cable end connector assembly (100) comprises a Serial ATA cable end connector (1), a IEEE 1394b cable end connector (2), and a cable (3) inter-connecting the Serial ATA cable end connector and the IEEE 1394b cable end connector. The Serial ATA cable end connector includes an insulative housing (10), and a plurality of contacts (11) retained in the housing. The IEEE 1394b cable end connector includes an insulative housing (20), and a plurality of contacts (21) retained in the housing. The cable interconnects the Serial ATA cable end connector and the 1394b cable end connector, the cable comprises, on a portion thereof, a metal braid (303) divided into a number of parts each soldered to a corresponding contact (11) of the Serial ATA.

3 Claims, 4 Drawing Sheets

CABLE END CONNECTOR ASSEMBLY

BACKGROUND OF THE INVENTION

1. Field of the Invention

The present invention relates to a cable end connector assembly and a method for making the same, and more particularly to a Serial ATA (Advanced Technology Attachment) cable end connector and IEEE (Institute of Electrical and Electronic Engineers) 1394b cable end connector assembly and a method for connecting Serial ATA cable end connector assembly and IEEE 1394b cable end connector assembly.

2. Description of the Related Art

IEEE 1394b connectors are commonly used to connect external and internal peripheral devices to a computer for performing data transmission therebetween. There exists in the art an electrical connector assembly known as a Serial ATA cable end connector assembly which is generally used for transmitting high speed signals between storage devices and a motherboard. In the past, when internal face is transmitted to external face, a PCBA (Printed Circuit Board Adaptor) is used to connect Serial ATA interface and IEEE 1394b interface respectively for achieving transforming function. However, the kind process of assembly is inconvenient, the cost of manufacture will be increased.

U.S. Pat. No. 6,496,862 discloses such an adaptor used for receiving an input data and transmitting the input data into an output request in a network system. However, the kind process of transmitting is inconvenient, and the cost of manufacture will be increased. Hence, an improved cable end connector assembly is required to overcome the disadvantages of the prior art.

SUMMARY OF THE INVENTION

A major object of the present invention is to provide a cable end connector assembly, which has integrally connection between a Serial ATA cable end assembly and a IEEE 1394b cable end connector assembly.

Another object of the present invention is to provide a cable end connector assembly, particular to a method which can increase convenience and reduce the cost of manufacture.

In order to achieve the object set forth, a cable end connector assembly comprises a Serial ATA cable end connector, a IEEE 1394b cable end connector, and a cable.

The Serial ATA includes an insulative housing, and a plurality of contacts retained in the housing. The IEEE 1394b cable end connector includes an insulative housing, and a plurality of contacts retained in the housing. The cable inter-connects the Serial ATA cable end connector and the IEEE 1394b cable end connector, the cable comprises on a portion thereof, a metal braid divided into a number of parts each soldered to a corresponding contact of the Serial ATA.

Other objects, advantages and novel features of the invention will become more apparent from the following detailed description when taken in conjunction with the accompanying drawings.

DETAILED DESCRIPTION OF THE INVENTION

Figure 1:
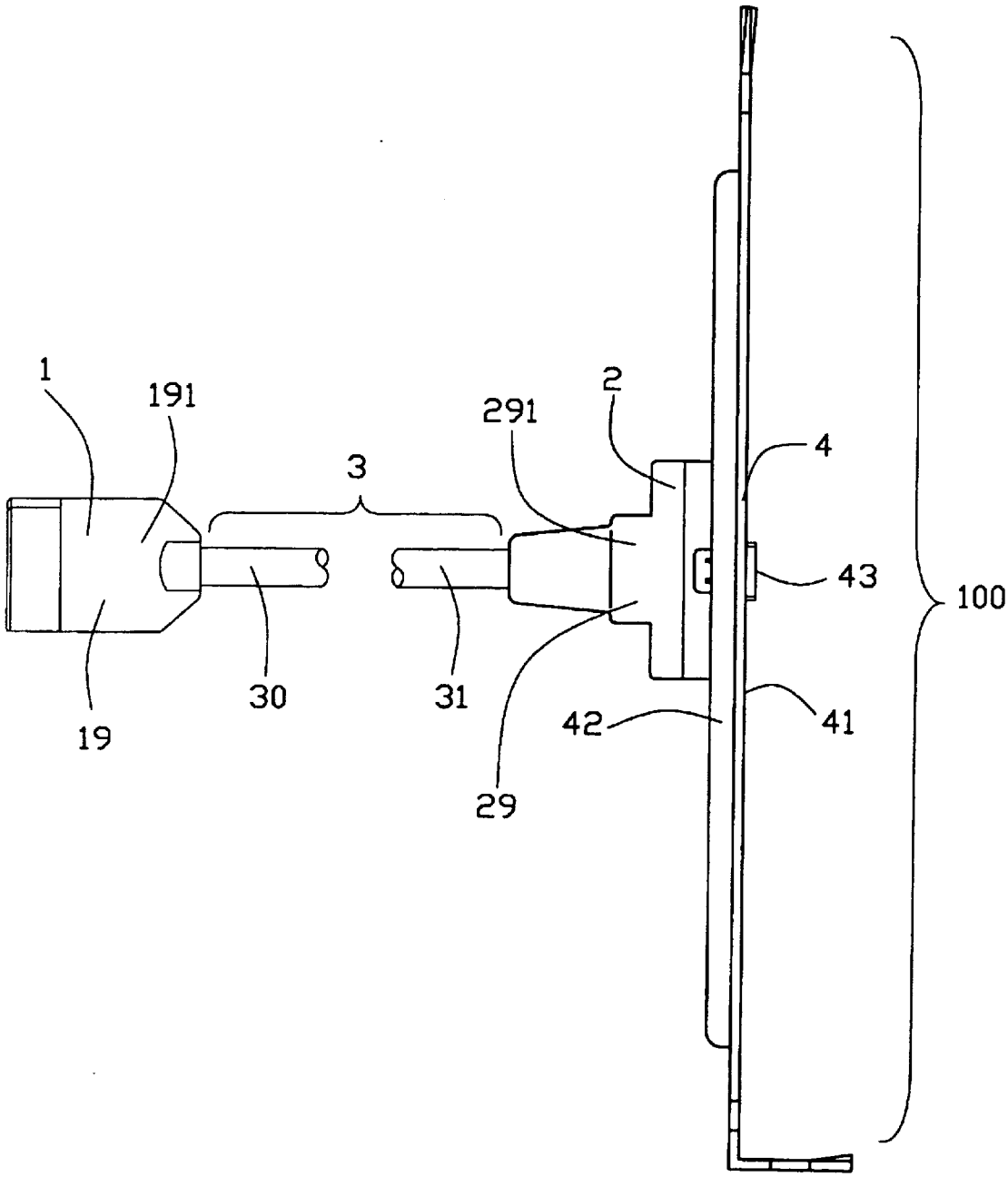
FIG. 1 is a front view of a cable end connector assembly in accordance with the present invention.
Figure 2:
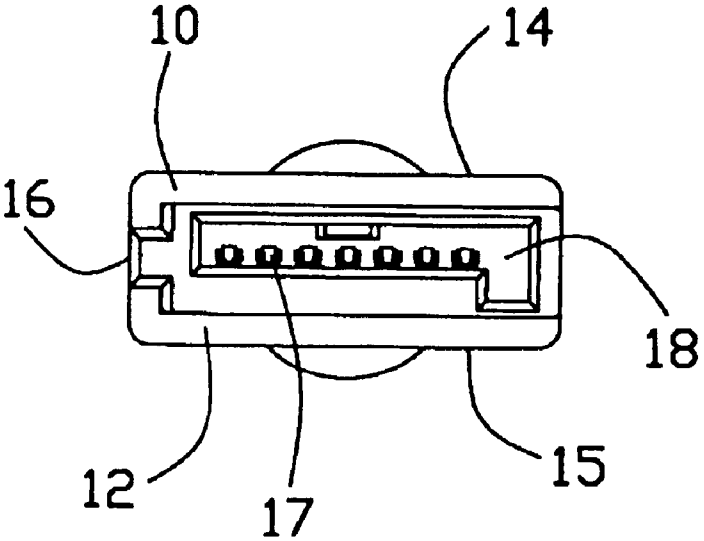
FIG. 2 is a left side view of the cable end connector assembly of FIG. 1.
Figure 3:
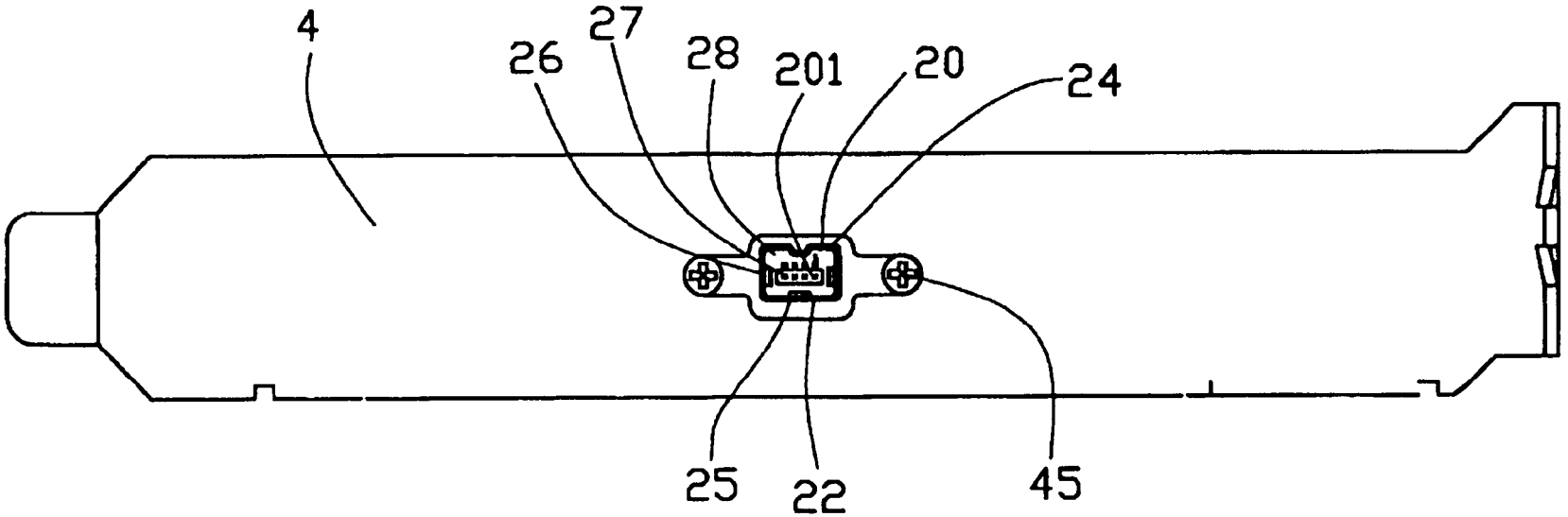
FIG. 3 is a right side view of the cable end connector assembly of FIG. 2.

Referring to FIGS. 1 to 3, a cable end connector assembly 100 comprises a Serial ATA cable end connector 1, a IEEE 1394b cable end connector 2, a cables 3, and a metal panel 4.

The Serial ATA cable end connector 1 comprises an insulative housing 10, seven contacts 11 (referring to FIG. 4) received in the housing, an over-molding cover 19 over-molded with the insulative housing 10, and a part of the cable 3.

The insulative housing 10 comprises a front end 12, a rear end (not shown), opposite top and bottom walls 14, 15, and opposite side walls 16. The top, bottom and side walls together define a L-shaped receiving space 18 therebetween for receiving a mating portion of a complementary connector (not shown). The bottom wall 14 defines a plurality of passageways 17 extending through the front and the rear ends 11, 12 for receiving the contacts 11.

The IEEE 1394b cable end connector 2 comprises an insulative housing 20, four terminals 21 (referring to FIG. 4) received in the housing 20, an over-molding cover 29 over-molded with the insulative housing 20, and a part of the cable 3.

The insulative housing 20 comprises a mating section 22, a back portion (not shown), opposite upper and lower walls 24, 25, and opposite lateral walls 26. The upper, lower and lateral walls together define a rectangular-shaped receiving space 28 therebetween for receiving a mating portion of a complementary connector (not shown). An island portion 201 is formed at center of the receiving space 28. The island portion 201 defines a plurality of passageways 27 extending along a front-to-rear direction for receiving the contacts 21. The cable 3 comprises a first portion 30 and second portion 31.

Figure 4:
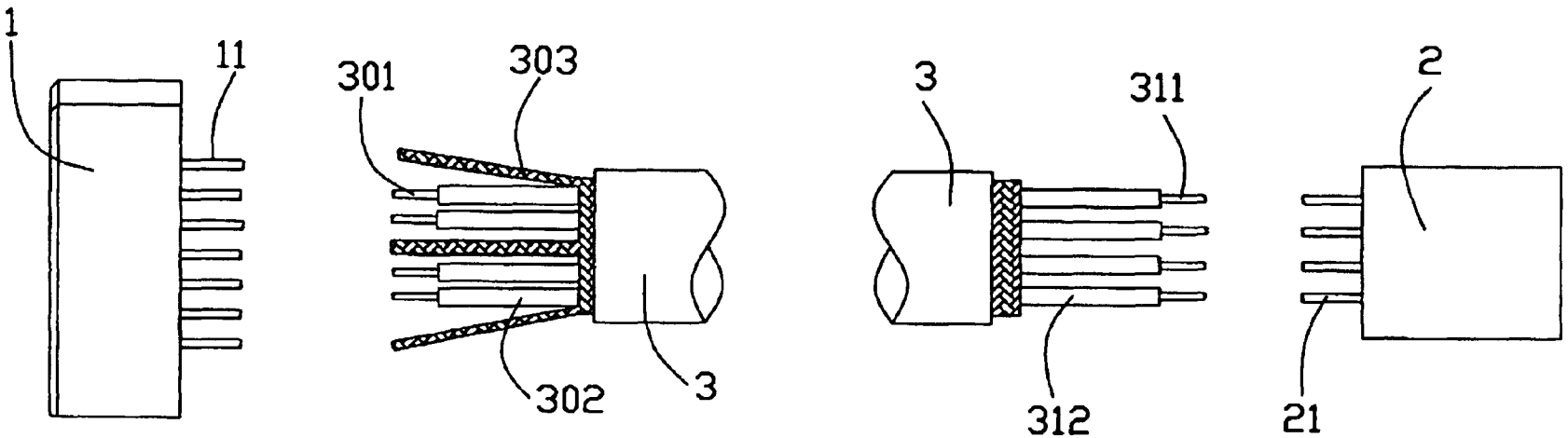
FIG. 4 is a partly exposed view of a cable end connector assembly.

Referring to FIG. 4, the first and second portion 30, 31 of the cable 3 comprises four conductive cores 301, 311, an insulative jacket 302, 312 surrounding and separating the conductive cores 301, 311 and the conductive cores 301, 311 extending beyond the insulative jacket 302, 312. A metal braid 303 enclosing the conductive cores 301, 311 and the insulative jacket 302, 312. The cable 3 is a cylinder-shaped. The metal braid 303 of the first portion 30 is divided into three parts on a top, middle, and bottom portion of the cable 3.

The metal panel 4 comprises a main portion 41, a flange 42 bent rearwardly and downwardly from the main portion 41, and a stamping hole 43 corresponding to the mating section 22 of the IEEE 1394b cable end connector 2, and a pair of screws 45 secured on both flanks of the stamping hole 43.

Referring to FIGS. 1 and 4, in assembly, the contacts 11, 21 are first assembled into the housings 10, 20, respectively. The four conductive cores 301 of the first portion 30 of the cable 3 are soldered with the contacts 11 of the Serial ATA cable end connector assembly 1. The first, fourth, and seventh contacts of Serial ATA Cable end connector assembly 1 are soldered with the three parts of the metal braid 303 on the top, middle, and bottom portion of the first portion 30 of the cable 3. In the second portion 31 of the cable 3, the four conductor cores 311 are solder with the contacts 21 of the IEEE 1394b cable end connector 2.

The over-molding cover 19, 29 is over-molded to the housing 10, 20 and the first and second portion 30, 31 of the cable 3, respectively. The over-molding cover 19, 29 is made of PVC and comprises a rectangular body 191, 291. A rear portion 292 extends rearwardly from the body 291 of the over-molding cover. Finally, the metal panel 4 is then assembled to the IEEE 1394b cable end connector 2, the stamping hole 43 mates with the mating section 22 of the insulative housings 20. The screws 45 are secured on both flanks of the stamping hole 43 for ensuring the connection between the metal panel 4 and the housing 20 of the IEEE 1394b cable end connector 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly comprising:

a Serial ATA cable end connector including an insulative housing, and a plurality of contacts retained in the housing, a IEEE 1394b cable end connector including an insulative housing, and a plurality of contacts retained in the housing; and a cable inter-connecting the Serial ATA cable end connector and the IEEE 1394b cable end connector, the cable comprising, on a portion thereof, a metal braid divided into a number of parts each soldered to a corresponding contact of the Serial ATA cable end connector;

wherein the metal braid is divided into three parts, a first, fourth, and seventh contacts of the Serial ATA cable end connector are soldered to the parts of the metal braid.

2. The cable end connector assembly as claimed in claim 1, wherein further comprising a metal panel having a hole receiving a mating section of the IEEE 1394b connector.

3. An interface cable assembly comprising:

a cable including four discrete inner conductors enclosed by inner insulative jackets, respectively, and further commonly enclosed in a braiding which is enclosed in an outer insulative jacket;

an IEEE 1394 connector including four contacts respectively mechanically and electrically connected to said four inner conductors at one end of the cable;

a serial ATA connector including seven contacts, four of which are respectively mechanically and electrically connected to said four inner conductors at the other end of the cable; wherein said braid is split to three pieces mechanically and electrically connected to the rest three of said contacts of the serial ATA connector around said other end;

wherein said three pieces equally separate said four inner conductors into two groups and substantially shielding each of said two groups around said other end.

* * * * *